US008171653B1

(12) United States Patent
Pennington

(10) Patent No.: US 8,171,653 B1
(45) Date of Patent: May 8, 2012

(54) GAITER ATTACHMENT OUTSOLE

(76) Inventor: Daryl Douglas Pennington, Rock Springs, WY (US)

( * ) Notice: Subject to any disclaimer, the term of this patent is extended or adjusted under 35 U.S.C. 154(b) by 860 days.

(21) Appl. No.: 12/157,871

(22) Filed: Jun. 14, 2008

(51) Int. Cl.
*A41D 17/02* (2006.01)

(52) U.S. Cl. ..... 36/2 R; 36/1.5; 36/59 R

(58) Field of Classification Search ..... 36/2 R, 36/1.5, 59 R, 59 C; D2/951–958
See application file for complete search history.

(56) References Cited

U.S. PATENT DOCUMENTS

| | | | | | |
|---|---|---|---|---|---|
| 421,906 | A | | 2/1890 | Carts et al. | |
| 921,435 | A | | 5/1909 | Miller | |
| 2,151,350 | A | | 3/1939 | Glowka | |
| 2,717,387 | A | | 9/1955 | McMahan | |
| 4,596,387 | A | | 6/1986 | Roberts | |
| 4,604,816 | A | | 8/1986 | Davison | |
| 4,713,895 | A | | 12/1987 | Vallieres | |
| 4,727,662 | A | | 3/1988 | Ilon | |
| 4,856,207 | A | | 8/1989 | Datson | |
| 5,613,250 | A | | 3/1997 | Bell | |
| 5,918,385 | A | * | 7/1999 | Sessa | 36/59 C |
| D440,748 | S | * | 4/2001 | Morgan | D2/957 |
| 6,295,742 | B1 | * | 10/2001 | Bathum | 36/59 R |
| 6,477,788 | B1 | | 11/2002 | Chen | |
| D487,612 | S | * | 3/2004 | Matis | D2/951 |
| D515,793 | S | * | 2/2006 | Huard | D2/957 |
| D530,891 | S | * | 10/2006 | Matis et al. | D2/953 |
| D537,611 | S | * | 3/2007 | Matis et al. | D2/953 |
| D556,985 | S | * | 12/2007 | Schoenborn et al. | D2/953 |
| D566,940 | S | * | 4/2008 | Schoenborn et al. | D2/957 |
| D574,131 | S | * | 8/2008 | Banik et al. | D2/956 |
| D576,395 | S | * | 9/2008 | Earle | D2/957 |
| D580,141 | S | * | 11/2008 | Banik et al. | D2/954 |
| D592,847 | S | * | 5/2009 | Rosenbaum | D2/957 |
| 7,631,440 | B2 | * | 12/2009 | Keen et al. | 36/50.1 |
| D612,136 | S | * | 3/2010 | Hubner | D2/954 |
| D632,879 | S | * | 2/2011 | Merkazy et al. | D2/953 |
| 2010/0024251 | A1 | * | 2/2010 | Delgatty | 36/101 |

* cited by examiner

*Primary Examiner* — Ted Kavanaugh

(57) ABSTRACT

An outsole with a configuration of protrusions that allows attachment of a gaiter. The protrusions may be similar to conventional lugs and perform ordinary lug functions or they may be highly specialized protrusions dedicated to attachment of a gaiter. Attachment is accomplished by jamming an expanded end of a gaiter cord amongst specialized surfaces on protrusions. Typically a gaiter cord first passes between protrusions typically on either the outboard side of footwear, or at the heel. Thereafter, the gaiter cord passes through a narrow slot and then enters a space wide enough for the expanded end. Tensioning of the gaiter cord further jams the expanded end of the cord in the outsole; thereby attaching the gaiter to the outsole.

20 Claims, 10 Drawing Sheets

GAITER ATTACHMENT OUTSOLE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

This invention relates to footwear, specifically to outsoles and their tread.

2. Discussion of Prior Art

Gaiters are conventionally attached to a boot by two lateral attachment points pulled downward by a cord that passes beneath the arch of the boot from one side of the gaiter to the other. Disadvantages include: that the cord can wear through with use; the portion of the cord beneath the outsole may build tip compacted snow to the point that one Must walk on one's arch, and lose traction; the cord at any point may catch on objects in the environment, such as branches; the inboard portion of the cord May catch a point a crampon or briefly snag a lug of the other boot.

Prior art shows unconventional gaiter attachment means to an upper of a footwear, such as: U.S. Pat. No. 6,477,788, to Chen, (2002), which shows a zipper and hook and loop means of attaching a gaiter to the top of the boot; and U.S. Pat. No. 4,856,207 to Datson, (1989), which shows a gaiter permanently fixed to the boot; and U.S. Pat. No. 4,604,816 to Davison, (1986), which shows a gaiter removably attached to a circumferential lip integral to the boot; U.S. Pat. No. 4,713,895 to Vallieres, (1987) shows a hook and pile means of attaching a gaiter to a shoe outsole. U.S. Pat. No. 4,596,387 to Roberts (1986) shows four means of attaching a loop of flexible material to an upper of a shoe, including hook and loop, rings, loops, and snaps. These designs require significant additions to the boot itself and their incumbent costs. Furthermore, many of these designs could snag on objects in the environment. U.S. Pat. No. 921,435 to Miller, (1909), shows a metal clip that allows the legging to rest on the top edge of the boot upper.

A set of unconventional, prior art, gaiter attachment means extending beneath the outsole are: U.S. Pat. No. 421,906, to Carts et al., (1890); and U.S. Pat. No. 2,717,387 to McMahan, (1955), and U.S. Pat. No. 5,613,250, to Bell, (1997); and U.S. Pat. No. 2,151,350 to Glowka, (1939), which show metal parts or a patch of fabric that hook or loop beneath the underside of footwear, and no special engagement surfaces on the footwear outsole. Similarly, U.S. Pat. No. 4,727,662 to ion (1988) shows a metal loop over a boot outsole. The metal parts and fabric could hook on objects and trip a wearer or fail by bending.

U.S. Pat. No. 2,151,350 to Glowka, (1939) also shows an outsole with a slot retaining a metal hook. It appears the hook might have a tendency to release from the slot.

OBJECTS AND ADVANTAGES

Accordingly, several objects and advantages of the present invention are:

(a) to allow gaiters of lower cost due to fabrication of fewer attachment points;

(b) to allow attachment of a gaiter with little or no need to replace its cord due to wear;

(c) to greatly reduce the problems associated with buildup of compacted snow;

(d) to reduce the likelihood of a cord or lower edge of a gaiter on catching on objects;

(e) to reduce the likelihood of the inboard portion of a cord catching a crampon point.

Further advantages are to provide improvement in aesthetics, reduction of weight, and cost due to the inboard gaiter bottom edge being higher than on conventional gaiters; hence requiring less fabric, parts, and labor. There is some reduction of extremely unlikely accidents of the nature of a vertical nail catching a gaiter cord, or worse, a nail rising vertically, but bent nearly horizontal above that base, so as to neatly hook a cord to a surface. Still further objects and advantages will become apparent from a consideration of the ensuing description and drawings.

SUMMARY

In accordance with the present invention: an outsole comprising traction protrusions forward and rearward of an arch, and a slot piercing the outboard side of the outsole that allows the retention of a cord which is in outboard-ward tension.

DRAWINGS

Figures

In the drawings, closely related figures have the same numeric prefix and a different alphabetic suffix.

DESCRIPTION

Definitions

In the description of the Figures: "top/bottom", "front/rear", "right/left" are colloquial instead of engineering terminology, therefore the right side of a boot is as viewed by a wearer, and "front" refers to the toe area. "longitudinal" refers to parallel to heel to toe direction, while "transverse" refers to perpendicular to longitudinal. "Inboard" refers to the left side of a right boot and the right side of a left boot. "Outboard" refers to the right side of a right boot and the left side of a left boot. "Interior" refers to more central, and farther from the sides, front, or rear sides of an outsole. "Exterior" refers to on, or towards a side, front, or rear of an outsole. "Axial" refers to the axis of a gaiter retaining slot, for example: the dimension along which a cord lays within the slot. In this device, the cord of a gaiter is jammed into a gap, void, trough, slot to attach the cord to the outsole and thereby the gaiter to the boot. The gap, void, trough, slot is defined by boundaries; either openings or boundaries defined by being contiguous with a solid surface, the rubber of the outsole. These boundaries are further classified as either mostly surrounding the length of cord or mostly surrounding the knot; the cord space boundary and knot space boundary, respectively. The term "gaiter-ward" means "along a length of a cord or slot, the direction most directly towards a gaiter".

FIG. 1

Preferred Embodiment

Figure 1:
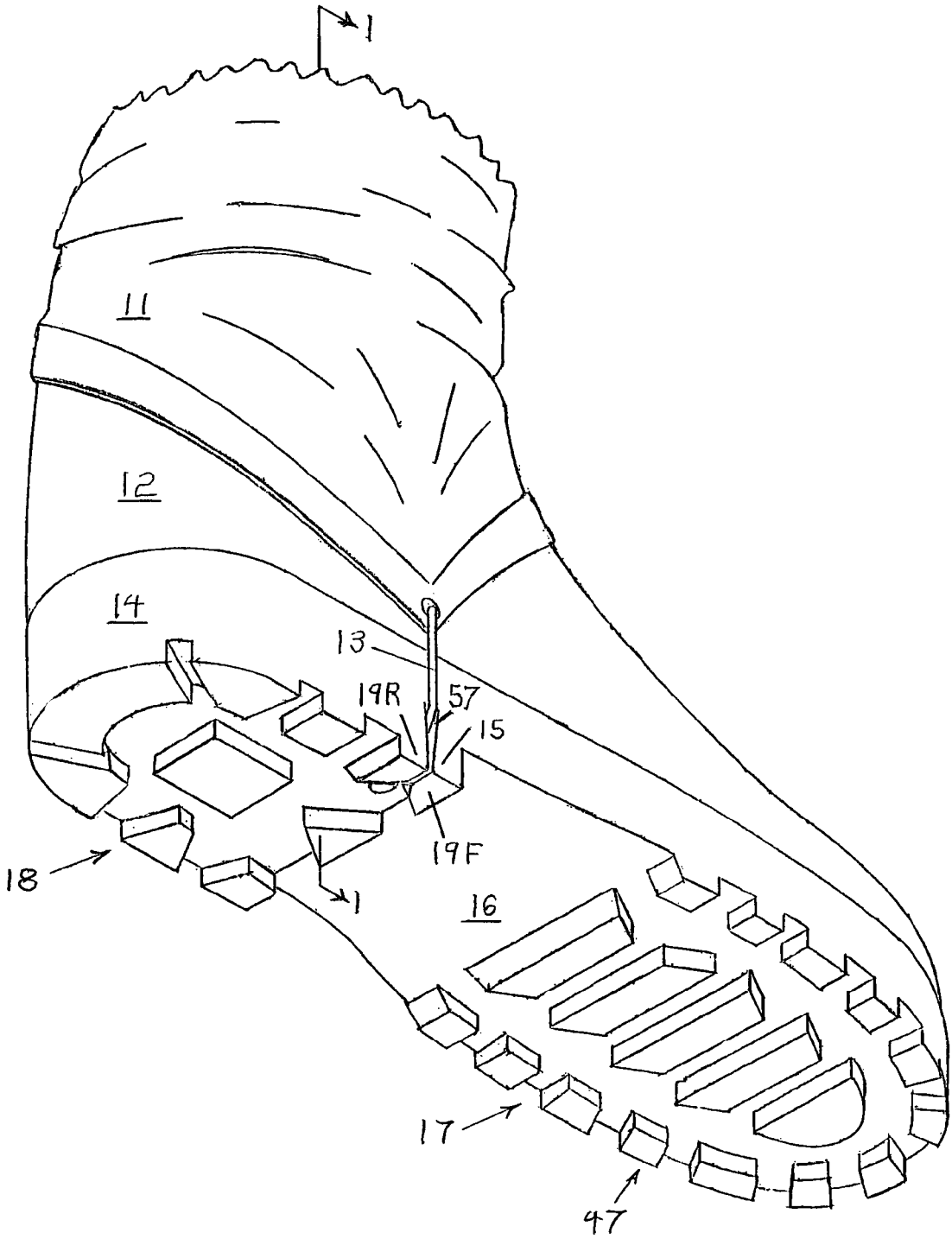
FIG. 1 shows a single gaiter attachment point outsole.
Figure 1A:
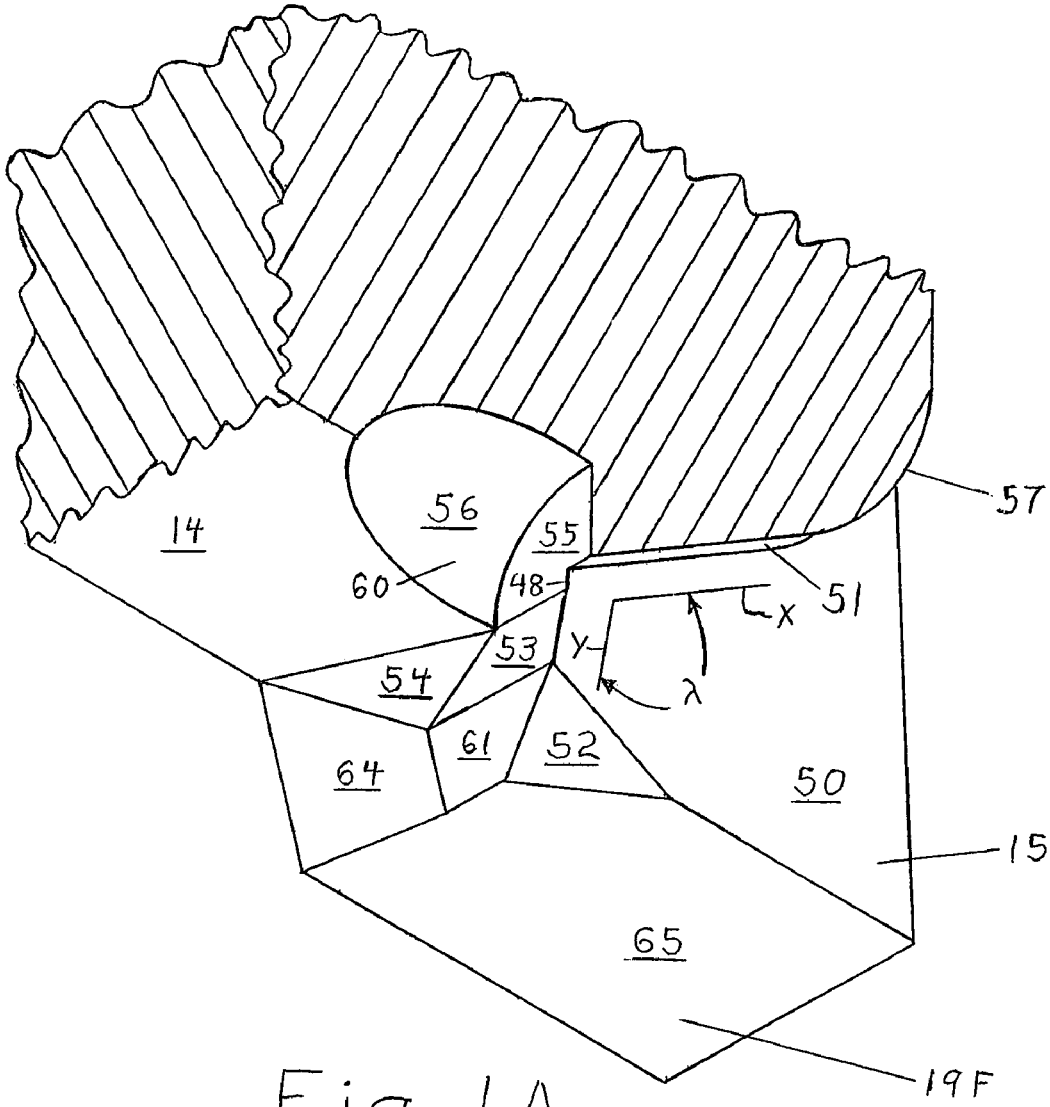
FIG. 1A shows a broken out portion of a gaiter attachment point.

FIGS. 1 and 1A is the rear, right (outboard), bottom perspective view of a right boot 12, outsole 14, and lower portion of a gaiter 11. Gaiter 11 is attached to boot 12 solely by a cord 13 which is attached to outsole 14 by lodging in a slot 15. Gaiter 11 is attached to cord 13 by conventional means of cord 13 knotting around the perimeter of a grommet set into fabric of gaiter 11. Outsole 14 is made of elastomeric material, typical boot outsole rubber. Outsole 14 has traction protrusions 47, occurring in two groups: front tread lugs 17 forward of an arch 16 as well as rear tread, lugs 18 rearward of arch 16. Arch 16 being a higher, lug-free surface between front lugs 17 and rear lugs 18. Arch 16 slopes upward-rearward to a transverse, vertical, planar surface which constitutes the forward boundary of rear lugs 18 and the front side of lug 19F. Slot 15 is a transverse, essentially-vertical trapezoidal gap between two adjacent traction protrusions, front attachment lug 19F and rear attachment lug 19R. Lug 19F is immediately rear of arch 16 and on the outboard side of outsole 14. Traversing inboard (interior), cord 13 first intakes into slot 15 within cord intake recess 57. Cord 13 then passes through slot 15 and lodges by means of a knot 58 jammed against the surfaces around the inboard slot terminus 48 of slot 15. The sectioning plane used in FIG. 1A is indicated with line 1-1.

FIG. 1A is a rear, left, bottom perspective view of lug 19F. This portion of outsole 14 is defined by broken-out boundaries and the sectional cutting-plane indicated by line 1-1 in FIG. 1 which includes the axis of slot 15, and divides slot 15 into identical halves; for illustration purposes cord 13 and its knot 58 are omitted. FIG. 1A shows lug 19F as roughly box-shaped except for the complex, inboard region. The bottom side 65, minor, inboard surface 61, major, inboard surface 64 and nock surface 52 are all surfaces comparable to analogous surfaces on many commonly shaped boot lugs. Major inboard surface 64 and minor inboard surface 61 primarily face inboard and downward. Nock surface 52 is planar, triangular and faces downward, rearward, and inboard. FIG. 1A also shows reference lines X, Y, which form angle λ. Lines X, Y, are in the vertical plane which contains cord 13 axis in the region below a slot ceiling 51. Line X is parallel to inboard portion of ceiling 51. Line Y is parallel to abutment surface 53.

Surfaces on and near lug 19F more closely related to the functionality of this invention are: slot wall 50, slot ceiling 51, abutment surface 53, guard surface 54, thrust surface 55, knot recess surface 56. These can be divided into two groups: those forming a cord space, and those forming a knot space 60. The first two surfaces 50, 51 and their counterparts on lug 19R form the cord space, which is the upper portion of slot 15. The second four planar surfaces 53, 54, 55, 56 and their counterparts on lug 19R form knot space 60. The functionality surfaces of lug 19R being mirror-images of functionality surfaces of 19F through the cutting-plane 1-1.

Wall 50 is planar, transverse, and slopes 86° to horizontal, upward-frontward. Slot 15 juncture with surfaces 53, 55 is inboard slot terminus 48. Therefore vertical sections of cord slot 15 have trapezoidal shapes perpendicular to its axis. Inboard slot opening 48 is planar, longitudinal and slopes 30° to horizontal, upward-outboard-ward. Shown is the front half of ceiling 51, which is planar immediately outboard of the inboard opening of slot 15. Outboard of that planar area, ceiling 51 becomes curved around a longitudinal axis; the 30° slope increasing to tangential to the outboard side of outsole 14. Outboard-ward slot 15 widens and becomes a broad, shallow, near-vertical recess 57 into which cord 13 enters slot 15 from gaiter 11.

Figure 1B:
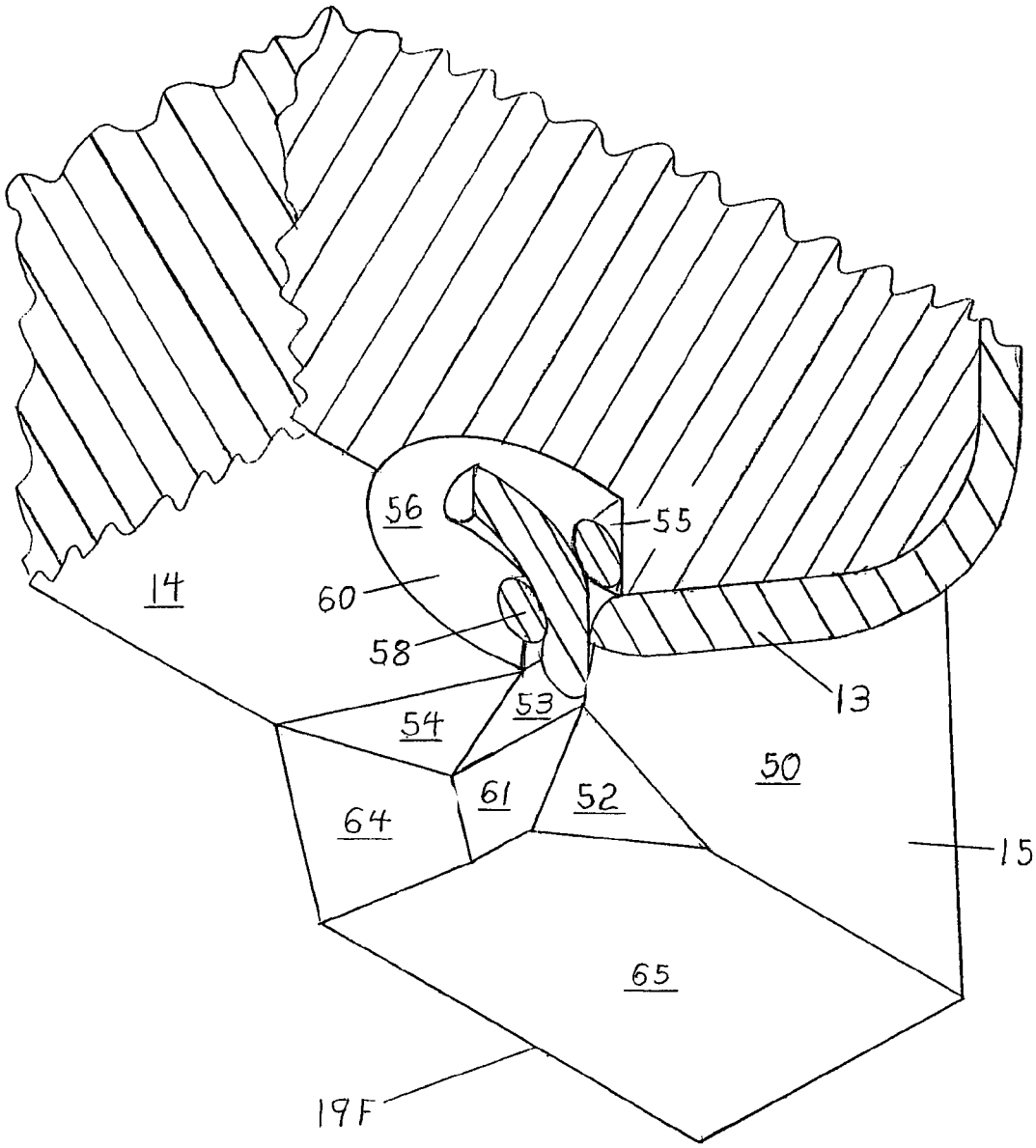
FIG. 1B shows the same broken out portion with a gaiter attachment cord.

FIG. 1B shows the same view of a portion of insole 14 as does FIG. 1A and includes cord 13 and knot 58 in slot 15 and knot space 60, respectively. Knot space 60 roughly surrounds knot 58 on 5 sides. Knot 58 thrusts against abutment surface 53 and vertical, thrust surface 55. Abutment surface 53 slopes upward outboard-ward at 75° to horizontal and adjoins vertical, thrust surface 55 along a horizontal, longitudinal edge. Thrust surface 55 outboardly caps recess surface 56 of an ellipsoidal recess in which knot 58 resides. Guard surface 54 faces upward, inboard and forward, thus partly faces knot 58 and is overhung by outsole 14.

Operation FIG. 1

Installation starts with inserting cord 13 into the nock made by nock surfaces 52 and its counterpart on lug 19R and then pulling cord 13 outboard-ward until knot 58 abuts abutment surface 53 and thrust surface 55. With more tension; cord 13 will come to rest against ceiling 51. The 30° slope of ceiling 51 combined with the 75° slope of abutment surface 53 shown on FIG. 1A to sum to the net angle λ between abutment surface 53 and cord 13 to be 135° at the inboard opening of slot 15. The angle being obtuse means that one component of the tensional force of cord 13 forces knot 58 upward and into recess surface 56. Being forced upward, it is forced away from the bottom edge of abutment surface 53. Retention would fail if knot 58 pulled past the bottom edge of abutment surface 53. Guard surface 54 shields knot 58 from objects on the ground. The bottom opening of slot 15 is narrower than ceiling 51; this helps exclude debris and retain cord 13. Cord 13 may be pulled with reciprocating motion to allow cord to be used in "sawing" fashion to clear slot 15 of mud, snow, debris, etc. Removal of cord 13 is accomplished by pulling on cord 13 in a direction approximately 150° to 180° from the direction of pull for installation.

FIG. 2

Figure 2:
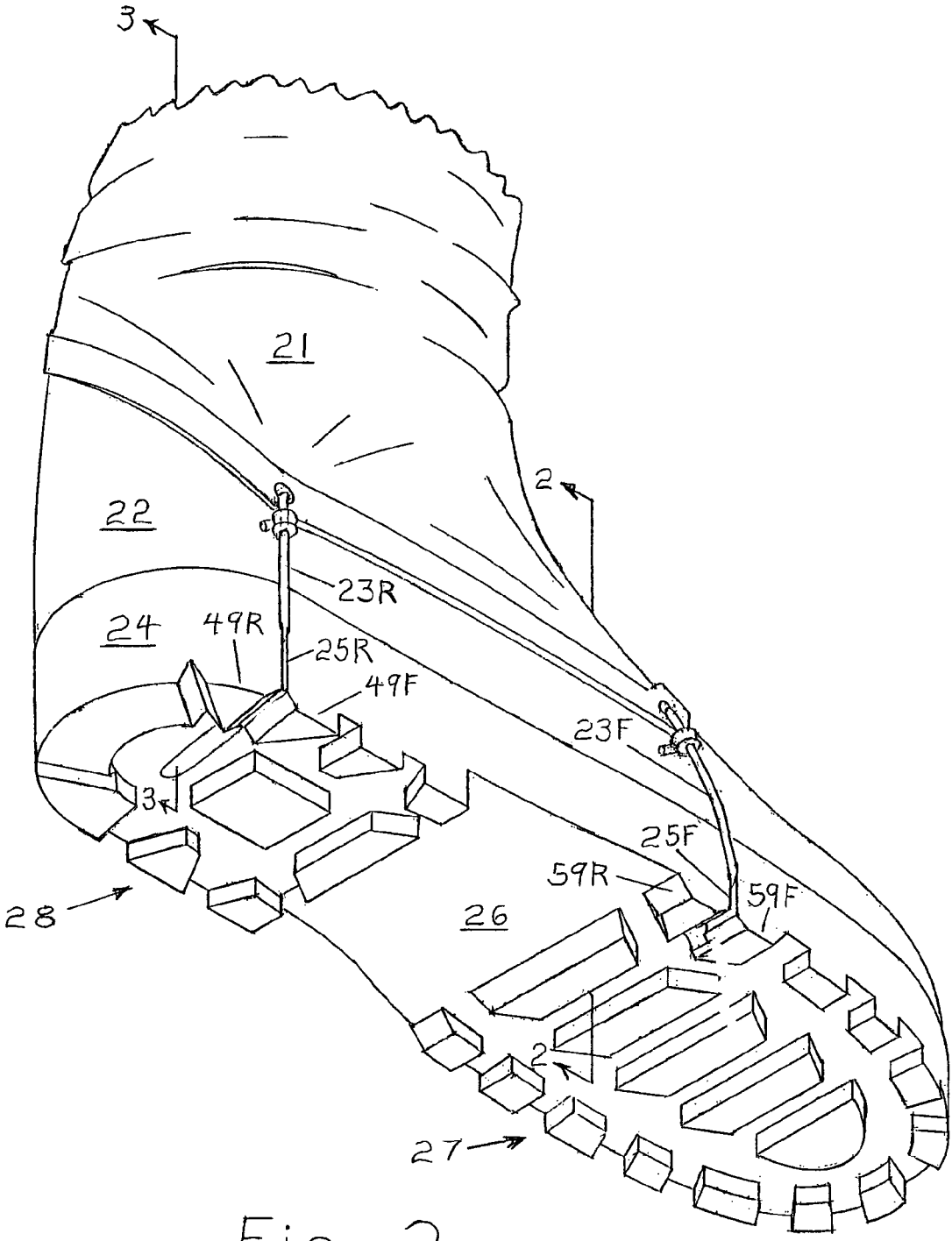
FIG. 2 shows an outsole with both front and rear gaiter attachment points.

FIG. 2 is a perspective view of the rear, bottom, outboard sides of right boot 22 and lower portion of a gaiter 21. Gaiter 21 is attached to boot 22 solely by two cords 23F and 23R to an outsole 24 by their lodging in two slots 25F (front) and 25R (rear). Gaiter 21 is attached to cords 23F, 23R by conventional means of cords 23F, 23R knotting around the perimeter of grommets set into gaiter 21. Outsole 24 is made of elastomeric material; typical boot outsole rubber. Outsole 24 has traction protrusions, front lugs 27 forward of an arch 26 as well as traction protrusions, rear lugs 28 rear of arch 26. Arch 26 being a higher, lug-less surface between front lugs 27 and rear lugs 28. Arch 26 slopes upward rearward to a transverse, vertical, planar surface forward of rear lugs 28. Transverse, vertical slot 25F is a gap between two protrusions, attachment lugs 59F, 59R. Approximately 101° forward to longitudinal; slot 25R is a vertical gap between two protrusions, attachment lugs 49F, 49R. Cords 23F, 23R are attached to outsole 24 by lodging in slots 25F, 25R. The sectioning plane used in FIG. 2A and FIG. 2B is indicated with line 2-2 and 3-3, respectively.

Figure 2A:
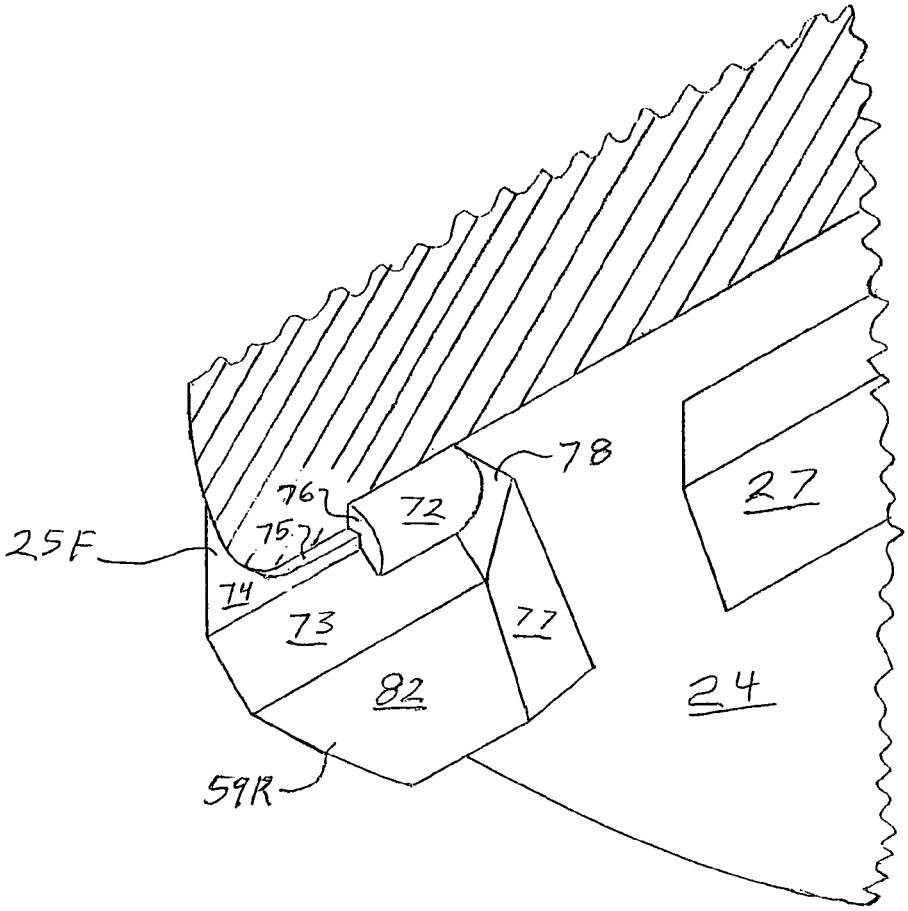
FIG. 2A shows a broken out portion of the front attachment point of FIG. 2.

FIG. 2A shows the front, left, bottom perspective view of a broken-out portion of outsole 24 bounded by plane 2-2. The sectioning plane indicated by line 2-2 includes the axis of slot 25F, and divides slot 25F into identical halves. Rear side, outboard side, inboard side 77, slot trench surface 73, nock surface 78 and bottom surface 82 are shaped and function similar to analogous surfaces commonly found on boot lugs.

Surfaces shown in FIG. 2A on or near attachment lug 59R which cause the functionality of this invention are: slot wall 74, slot ceiling 75, abutment surface 76. Slot walls 74 are transverse, vertical and planar. Slot ceiling 75 is horizontal, planar near its inboard terminus, and increasing in slope outboard-ward to tangential with the outboard side of outsole 24. In use, cord 23F rests between wall 74 and its counterpart on lug 59F, and against ceiling 75. In use; a knot in cord 23F is located mostly within knot space boundary 72 and abuts abutment surface 76. Knot space boundary 72 is a horizontal, right, circular, cylindrical surface. The upper surface of boundary 72 is tangential with the plane containing the bottom surface of outsole 24 between the traction protrusions. Some of boundary 72 is overhung by another portion of boundary 72. Abutment surface 76 is planar, vertical and longitudinal.

Figure 2B:
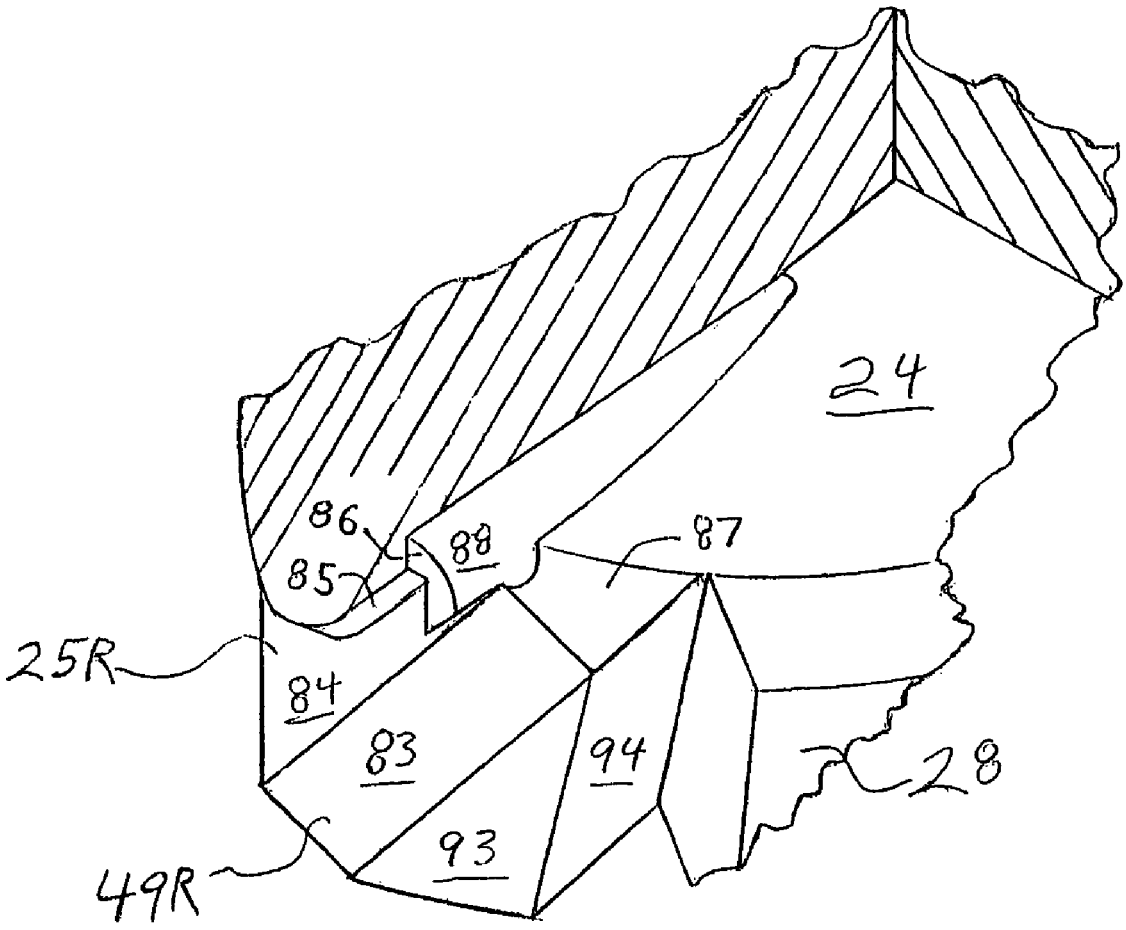
FIG. 2B shows a broken out portion of the rear attachment point of FIG. 2.

FIG. 2B shows the front, left, bottom perspective view of a broken-out portion of outsole 24 bounded by line 3-3. The sectioning plane indicated by line 3-3 includes the axis of slot 25R, and divides slot 25R into identical halves. Rear side 94, outboard side, inboard side 87, lug bottom 93, and slot trench surface 83, are shaped and function similar to analogous surfaces commonly found on boot lugs.

FIG. 2B shows the surfaces on or near attachment lug 49R which cause the functionality of this invention: slot wall 84, slot ceiling 85, abutment surface 86. Slot walls 84 are transverse, vertical and planar. Slot ceiling 85 is horizontal, planar near its inboard terminus, and increasing in slope outboard-ward to tangential with the outboard side of outsole 24. In use, cord 23R rests between wall 84 and its counterpart on lug 49F, and against ceiling 85. In use; a knot in cord 23R is located almost entirely within knot space boundary 88 and abuts abutment surface 86. Knot space boundary 88 is a horizontal, right, circular, cylindrical surface that slopes approximately 6° to horizontal and extends beyond the space that may enclose a knot. Some of boundary 88 is overhung by a higher portion of boundary 88. Abutment surface 86 is planar, vertical and approximately 11° from longitudinal. Inboard side 87 is roughly triangular section of a vertical cylinder. Slot trench surface 83 is a planar rectangle sloping 45° to horizontal.

Operation—FIG. 2

Insertion and removal of cord 23F, 23R into slot 25F, 25R is similar to operation of the system shown in FIG. 1. λ for this embodiment is 90°, so there is no retention effect of an obtuse λ. Instead, the lower, lobe-like, lip-like protrusion forming knot boundary 72, 88 retains the knot of cord 23F, 23R from being pulled down and out of retention by simple mechanical interference.

FIG. 3

Figure 3:
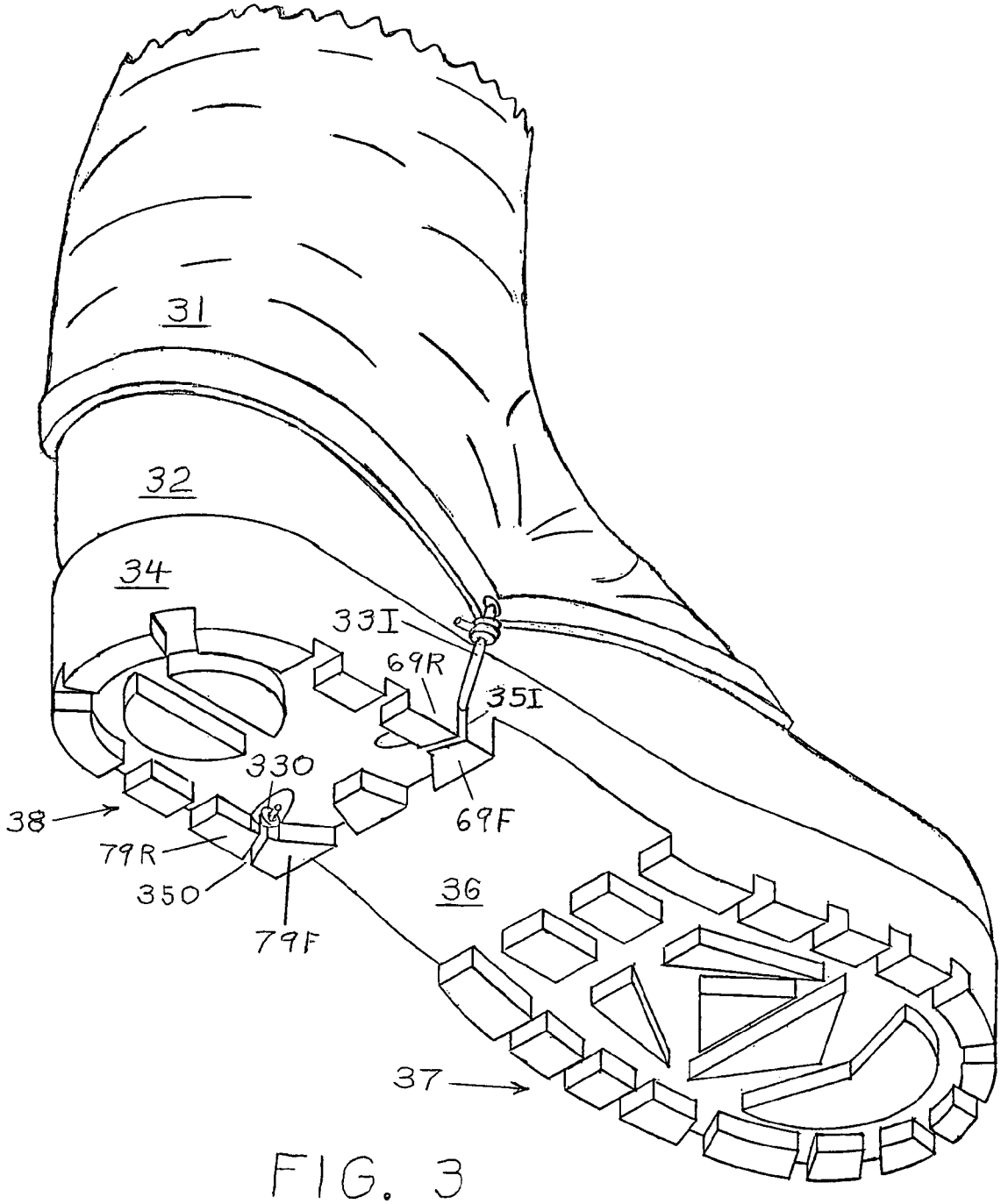
FIG. 3 shows an outsole with one inboard and one outboard attaching point.

FIG. 3 is a perspective view of the rear, bottom, inboard sides of left boot 32 and the lower portion of a gaiter 31. Boot 32 features an outsole 34 which attaches gaiter 31 with an attachment point on each side. Gaiter 31 is attached to boot 32 by cords 331, 330 (inboard and outboard). The cord knots lodge in outsole 34 inboard of two slots 351, 350 (inboard and outboard). Gaiter 31 is attached to cords 33I, 33O by conventional means of cords 33I, 33O knotting around the perimeter of grommets set into gaiter 31. Outsole 34 is made of elastomeric material, typical boot outsole rubber. Outsole 24 has traction protrusions, front lugs 37 forward of an arch 36; as well as traction protrusions, rear lugs 38 rear of arch 36. Arch 36 being a higher, lug-less surface between front lugs 37 and rear lugs 38. Arch 36 slopes upward-rearward to a transverse, vertical, planar surface forward of rear lugs 38. Approximately 72° forward to longitudinal, vertical slots 35I, 35O are a gap between protrusions, inboard attachment lugs 69F, 69R and outboard attachment lugs 79F, 79R. The knot space and slot space of this embodiment are very similar to those of the rear attachment point of the embodiment of FIG. 2, as best seen in FIG. 2B.

Figure 4:
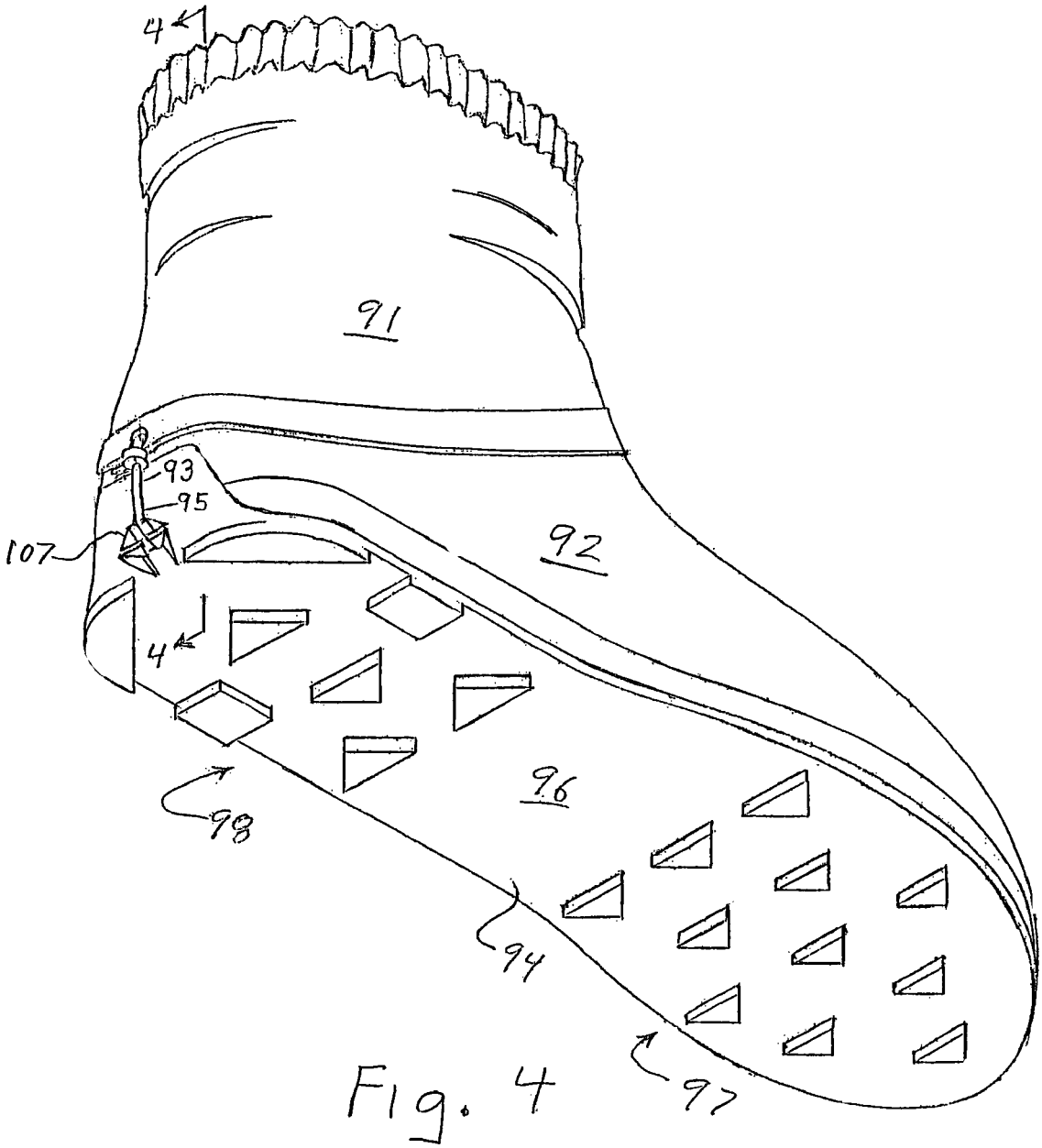
FIG. 4 shows an athletic shoe with a gaiter attachment point on its rear side.
Figure 5:
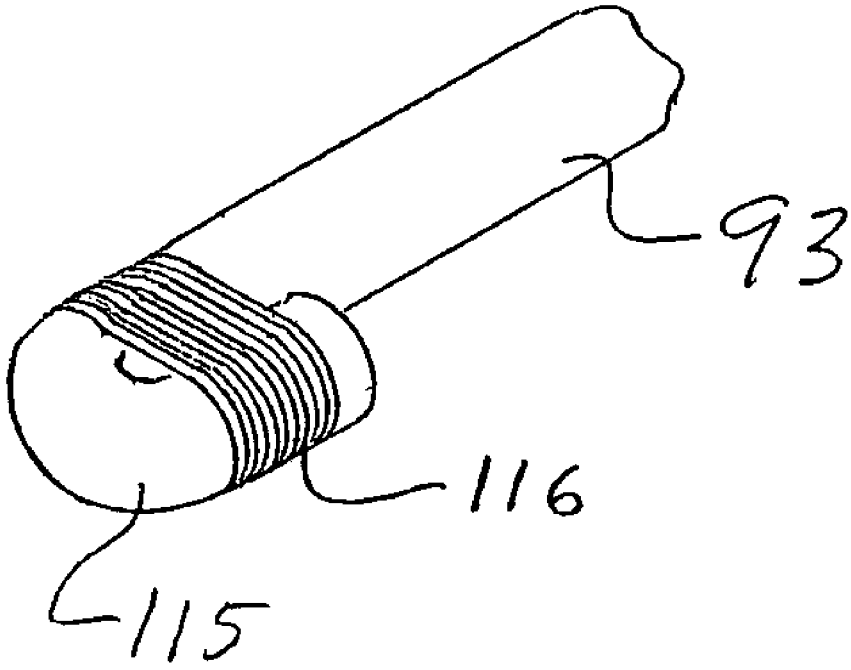
FIG. 5 shows a modification to a cord used for clearer understanding of FIG. 4.

FIGS. 4 and 5

FIG. 4 is a perspective view of the rear, bottom, outboard side of right athletic shoe 92 and a scree gaiter 91. Shoe 92 features an outsole 94 which attaches gaiter 91 with a single gaiter attachment point 107 on the rear of shoe 92. Gaiter 91 is attached to shoe 92 by cord 93 which attaches to outsole 94. Gaiter 91 is attached to cord 93 by conventional means of cord 93 knotting around the perimeter of grommets set into gaiter 91. Outsole 94 is made of typical shoe outsole rubber, elastomeric material. Outsole 94 has traction protrusions, front lugs 97 forward of a lug-less surface arch 96 as well as traction protrusions, rear lugs 98 rear of arch 96. Formed in outsole 94 are a number of surfaces, attachment point 107, in which cord 93 lodges. Attachment point 107 is primarily on the rear of shoe 92, and partly on the bottom of shoe 92. The sectioning plane used in FIG. 4A is indicated with line 4-4.

Figure 4A:
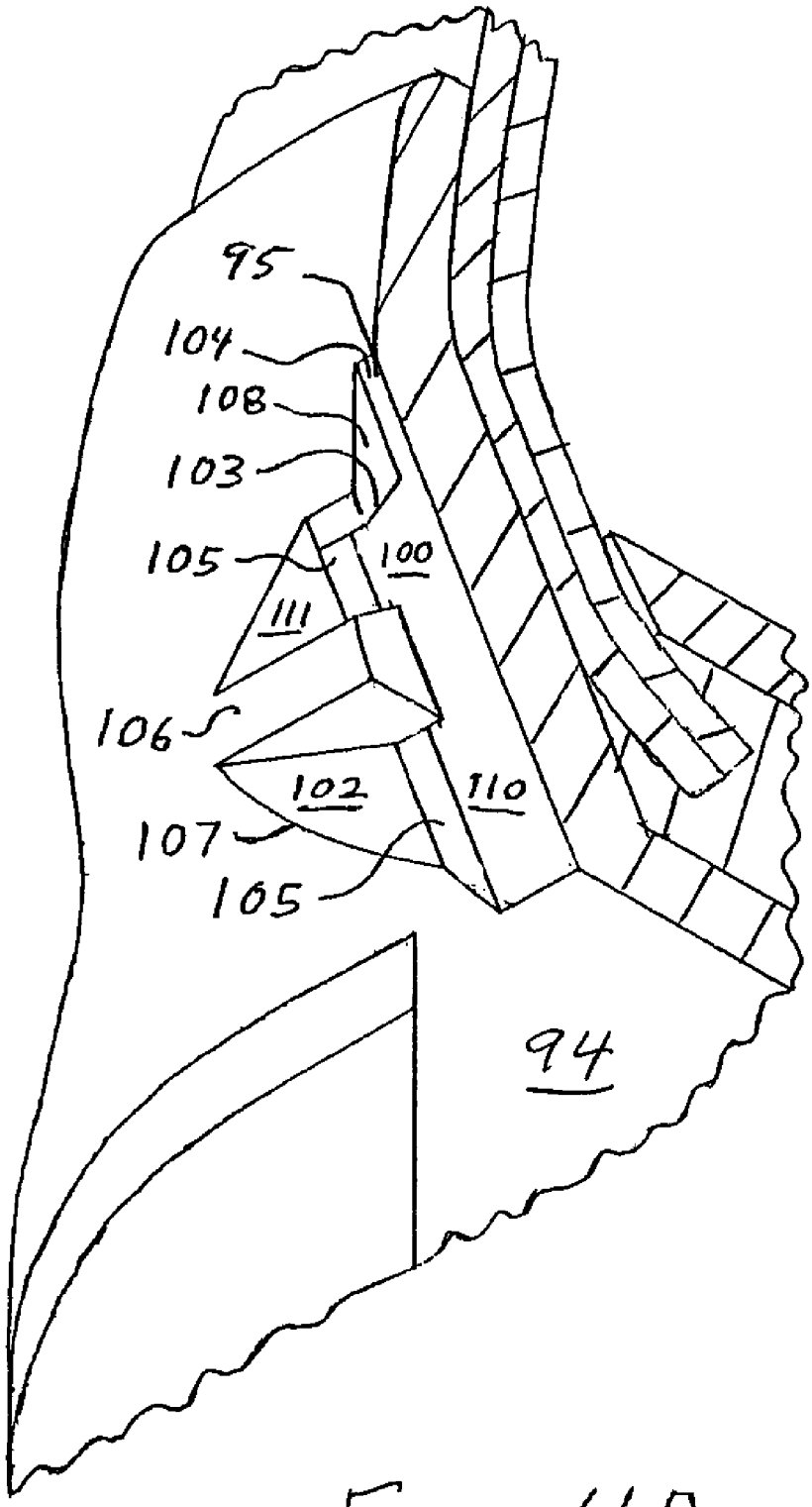
FIG. 4A shows a broken out portion of the attachment point of FIG. 2.

FIG. 4A is a right, rear, bottom, perspective view of a portion of shoe 92. The portion is both broken-out and bounded by cutting plane 4-4 showing the left half of heel counter, attachment point 107. The sectioning plane indicated by line 4-4 includes the axis of cord slot 95, and divides slot 95 and the entire attachment point 107 into mirror-halves. The upper portion of attachment point 107 is a combination of cord slot 95 and an abutment surface sloped to force a cord end deeper within attachment point 107. The lower portion of attachment point 107 includes retaining lobes, dogs 106 extending over a space 100 for a cord end 115.

The axis of slot 95 is in a vertical, longitudinal plane. Slot 95 is parallel-sided and tapers from zero depth above to a few millimeters depth below at its juncture with cord end space 100. The top/front surface of slot 95 is a slot ceiling 104; which is planar, transverse and slopes 60° to horizontal, upward-rearward. Slot 95 is bounded laterally by a slot space wall 108 and its mirror-counterpart. Slot 95 terminates below at an abutment surface located immediately left of its inboard, abutment surface edge 103. The abutment surface is planar, transverse, four-sided, and slopes 45° to horizontal upward-forward. Thus it makes an obtuse angle of 105° with ceiling 104 when measured as is measured in FIG. 1A.

Cord end space ceiling 110 is coplanar with slot ceiling 104. Cord end space 100 is trapezoidal viewed along the slot axis with knot space ceiling 110 being the wider of the trapezoid's parallel edges and its rearward opening being the narrower of its two parallel edges. The sides of the trapezoidal shape are identical, mirror, planar, slot space walls 105. Dogs 106 are trapezoidal viewed in sections parallel to plane 4-4.

Dog 106 and its mirror-counterpart partly cover cord end space 100, leaving a gap between them through which a cord may pass. Located between dogs 106 and the abutment surface, relief surface 111 flanks cord end space 100. Surface 111 slopes rearward away from cord end space 100. Downward of dogs 106 cord end space 100 is flanked by planar, nock surfaces 102.

FIG. 5 shows the right, top, rear sides of cord end 115 broken-out from cord 93. End 115 is merely a 180° bend in cord 93 with a whipping 116 holding it together. This forms cord end 115 that cannot pass through slot 95 due to interference. It is shown to illustrate a cord end that is flatter than a knot, and thereby more suitable for this embodiment.

Operation—FIG. 4

Insertion of cord 93 in slot 95 is done by placing end 115 in cord end space 100 between nock surfaces 102. This might be done by elasticity of gaiter 91 or by closing a frontal gaiter zipper after placing end 115 in cord end space 100. Tension upon cord 93 pulls end 115 under dogs 106 and against the abutment surface. Removal of cord 93 is accomplished by pulling more rearward than upward on the gaiter-ward portion of cord 93. This force extracts end 115 from cord end space 100 through the opening between relief surface 111 and its mirror-counterpart, with some flexure of dogs 106. Attachment point 107 retains cord 93 by use of an obtuse angle λ as well as interference by dogs 106.

CONCLUSION, RAMIFICATIONS, AND SCOPE OF THE INVENTION

Thus the reader will see that this invention provides a safer, more convenient, and higher performance means of attaching a gaiter to a boot. Rarely, the gaiter cord can catch on a foreign object, or ones own gear, and this invention reduces such occurrences. Commonly it occurs that on snow, or mud, that a gaiter cord gathers material and causes endless, uneven, uncomfortable walking, as well as shaking of the boot to dislodge the material. This invention lacks the source of these problems. Additionally, it saves a user time lost to replacing a worn cord. In the case of athletic shoes lacking an arch, there are at least three benefits: the present invention cannot be felt underfoot, and; the cord does not constantly abrade on the ground surface, and; the cord is not able to catch on objects underfoot.

While my above specification provides many specificities, many other embodiments are viable. The outsole 24 of FIG. 2 could be modified to have one or more attachment points on its inboard side. Any combination of single or multiple attachment points on any or all sides may be viable. For example: an outsole could have attachment point(s) on its outboard side as well as its rear side. To accommodate a gaiter cord on a side; an outsole, and/or welt, and/or rand may be recessed deeper than slot 15.

The outsole may be made of any sort of elastomeric compound. It may be variable in density, elasticity, flexibility, color, durability and friction coefficients. A knot space boundary and/or slot space boundary elastomer may be very soft to allow release of snagged objects, nails, etc. The juncture between knot space and cord space may be a region of reinforcement; such as more competent elastomer, less flexible elastomer, embedded metal or plastic.

Slot shape may vary considerably. A cord slot may close onto itself underneath a cord, thus precluding collection of snow, mud and stones. Such a close-lipped slot would only open upon insertion and removal of a cord. Facilitation of insertion may be by formation of the close-lipped slot at the top of an inverted V-shaped trough designed to spread the sides of that cord slot. A similar slot wall spreading structure may be formed below the slot ceiling. A slot may widen downward from its ceiling. A slot may have a cord-protective ridge of retaining protrusions just below the cord's location, with the slot widening below that. Slot orientation and location may vary considerably: a slot may be angled such that a cord from a gaiter enters the slot under the arch of the footwear, such as in the vertical, transverse surface just rear of the arch. A slot axis viewed from below may be curved or have an angle(s) in its length. Thusly, a knot space may be oriented along a different axis than some or all of the slot space. Measured in a horizontal plane and perpendicular to the slot axis; a slot may narrow at or near its junction with a knot space. A slot may have ridges, protrusions, lips, etc to retain the cord or knot. A slot space or knot space may be crossed by a slot, such that it may appear that the slot space is formed by more than two lugs or protrusions. A slot ceiling may be penetrated by a much more narrow slot, or by a cut in the outsole that does not open to leave a slot. A slot may have a V-shaped slot ceiling.

The attachment point of FIG. 4 may be formed in the rear of the shoe instead of the rear of the outsole. In this case it might be formed in material of different composition than the outsole; such as leather or plastic. The attachment point of FIG. 4 could be formed lower on the shoe, and/or face more downward, and be formed by two or more traction protrusions.

A slot boundary may have twist or otherwise mate with a knots' shape and/or cords' shape. A slot may have double-butted ends or a wider midsection such that a plug may be placed to fill the slot when a gaiter is not used; and the plug may be retained by interference against downward as well as slot axial forces. A plug may be retained by hook and loop devices. A knot space and cord space may be entirely below the bottom surface of an outsole between lugs. The abutment surface may be convex towards the knot; such as dome, or a frustum with the inboard terminus of a slot bisecting that abutment surface. A knot space may have a wider space than required for the knot to allow the knot to be turned around more easily during extraction. This might be done by allowing more space beneath or above the knots' in-use location. A slot need not be approximately vertical, it may be horizontal, such as with one wall flush with the outsole surface between traction protrusions.

A gaiter attachment point may be designed for a cord of any shape or type construction. A cord could be substituted by metal cable, plastic strap, plastic bar, elastic cord, elastic fabric, webbing, etc. Any expanded end device may be substituted for a knot. For example; a cord may thicken as a substitute for a knot by use of an end splice, or additional fibers, alteration or replication of a weaving pattern, or melting, or addition of objects within its core or woven into its sheath or mantle. Thickening may be accomplished by: coiling, or braiding, or weaving, or laying of its core, or its cover, or its entirety. A gaiter attachment point may be designed for a cord with any system of knot, ferrule, or a ring, washer, or a swaged plastic end, or swaged metal end, or applied molten plastic end, or plastic parts that snap or clamp onto the end of a cord, or metal parts that snap or clamp onto the end of a cord, or thick whipping, or thick, close stitching similar to embroidery, or rubber wedge or other shaped stopper, or other part may be substituted for knot and for causing interference. A plastic, metal or rubber hook or "L" or "T" shape having a combination of such interferences protrusions may be used as a cord expanded end. An outsole may have a expansion space that approximately mates with a hook, "L" or "T" shaped cord expansion. For example, a expansion space may deepen or widen near its interface with a cord slot to mate with a "L" or hook shaped cord expansion. A expansion space may expand outside of a cord slot in two opposing directions to approximately mate with a "T" shaped cord expansion end oriented approximately in a horizontal plane, the T shaped cord end space may be narrow and high in outsole to preclude retention of stones. A slot cord may be generally round or approximately strap shaped. A slot cord may be a strip of fabric or piece of webbing. Such webbing-type cord may be used to fill a slot to prevent mud and ice buildup. Such webbing-type cord may be used to allow a narrower slot to be used. Such webbing-type cord may have a expanded end formed by folding and stitching of itself or some roughly spherical or approximately planar plastic, rubber or metal end. Such webbing-type cord may twist or fold within a slot, such as twist to form a rope-like shape, or fold to form a double thickness portion approximately filling a slot. A wholly or partially plastic strap may be used to form a slot cord. Such a strap may have a thickened end of approximately planar shape, roughly spherical shape or a combination of both. Such a strap may have holes for use in a buckle. A slot and cord may substitute hook and pile for knot interference. A cord may be whipped or stitched with two bends. FIG. 5 shows a cord with a single bend whipped. Bend the end again and it forms a trigonal or flat cross section with a thickening on two sides of the cord. A gaiter attachment point may be designed to retain a variety of cord ends: a variety of knots in a variety of cord types as well as for both knots and ends composed of material other than that of the cord. For example: designed for both an overhand knot in 3 mm cord or and a 1 mm thick metal T-shaped end swaged onto a 2 mm cord.

Retention lobes may extend over a cord end space from one side, or both sides of the cord end space. Retention lobes may extend far enough to contact each other to better retain a cord end. Retention lobes may extend across a cord end space and connect to form a continuous loop of material over the cord end space, possibly leaving a hole through which a cord end might be pulled through to remove the gaiter.

I claim:

1. A gaiter attaching outsole, comprising: an outsole composed of elastomeric material, said outsole having a plurality of traction protrusions, wherein;

(a) a first protrusion, which has both a first exterior surface which faces generally away from said outsole, and a first interior surface, which faces generally across the bottom of said outsole, said first protrusion having a first slot wall surface which is contiguous on its exterior edge with said first exterior surface, said first slot wall being contiguous on its interior edge with said first interior surface, and;

(b) a second protrusion, which has both a second exterior surface which faces generally away from said outsole, and a second interior surface, which faces generally across the bottom of said outsole, said second protrusion having a second slot wall surface which is contiguous on its exterior edge with said second exterior surface, said second slot wall being contiguous on its interior edge with said second interior surface, said second slot wall approximately facing said first slot wall, and;

(c) a slot ceiling surface formed in said outsole between said first protrusion and said second protrusion, said slot ceiling surface being contiguous with both of the slot walls, said slot ceiling including the entire surface between said first slot wall and said second slot wall between the exterior surfaces and the interior surfaces, and;

(d) a slot being formed of said first slot wall and said second slot wall and said slot ceiling surface, an inboard slot terminus of said slot being including the locations at which said first interior surface and said second interior surface are contiguous with the slot walls, wherein;

(e) a slot axis plane being defined as the plane most nearly bisecting said slot as well as most nearly paralleling both of the slot walls, wherein;

(f) a reference line x coplanar with said slot axis plane, said reference line x being horizontal and tangential to said slot ceiling, wherein;

(g) a reference line y coplanar with said slot axis plane as well as coplanar with a slot terminus plane, said slot terminus plane being that plane which most nearly approximates the portions of the interior surfaces located immediately around the upper portion of said inboard slot terminus, a reference angle $\lambda$ defined as the angle between said reference line x and said reference line y both below said reference line x and exterior of reference line y, said reference angle $\lambda$ being obtuse, thereby upon a condition of a cord in tension within said slot, a knot in said cord is forced upward, and deeper into a knot space; reliably attaching said gaiter to a footwear.

2. The gaiter attaching outsole of claim 1, wherein said angle $\lambda$ is greater than 115°.

3. The gaiter attaching outsole of claim 1, wherein said angle $\lambda$ is greater than 130°.

4. The gaiter attaching outsole of claim 1, wherein said angle $\lambda$ is greater than 150°.

5. The gaiter attaching outsole of claim 1, wherein said angle $\lambda$ is less than 150°.

6. The gaiter attaching outsole of claim 1, wherein a heel counter extension of said outsole extends from said outsole and up the rear of said footwear, outboard of the heel counter, wherein said first exterior surface, and said second exterior surface are located on said heel counter extension.

7. A method of attaching a gaiter to a footwear, said method comprising:

(a) forming an outsole, including;

(b) forming in said outsole a cord slot, wherein said cord slot opens at least partially downward, wherein the direction of said downward and an upward direction are defined as being in usual sense upon condition of said outsole being in use on top of a horizontal surface, and;

(c) forming abutment surfaces in said outsole, wherein said abutment surfaces have normals which have an upward component, wherein said abutment surfaces are located adjacent to a distal terminus of said slot, and;

(d) constructing said footwear with said outsole, and;

(e) constructing a gaiter, and;

(f) constructing a gaiter attachment cord, wherein said gaiter attachment cord has a cord proximal end and a cord distal end, and;

(g) constructing a cord expanded end at said cord distal end, and;

(h) attaching said cord proximal end to said gaiter, and;

(i) placing surfaces of said cord expanded end against some or all of said abutment surfaces, and;

(j) placing the portion of said gaiter attachment cord near said cord expanded end within said slot, and;

(k) tensioning said gaiter attachment cord between said cord expanded end and said gaiter, and;

(l) fastening said gaiter around said footwear into a condition of usable assembly;

thereby securely attaching said gaiter to said outsole.

8. The method of claim 7, wherein some of said abutment surfaces are formed to face at least partially upward.

9. The method of claim 7, wherein construction of said gaiter attachment cord at least partially includes use of elastic material.

10. The method of claim 7, further including forming said gaiter attachment cord of such length that it terminates beneath said outsole.

11. The method of claim 7, further including forming said abutment surfaces such that an angle λ is obtuse, wherein said angle λ reference geometry is as follows:

(a) a cord axis which is coaxial with the center of said cord near to said abutment surfaces on condition of said cord being under tension in said condition of usable assembly, and;

(b) a slot axis plane being vertical and collinear with said cord axis, and;

(c) a line y defined as the intersection of a plane parallel with said slot axis plane and some of said abutment surfaces, and;

(d) a line y' defined as both intersecting said cord axis and being parallel with said line y, wherein said angle λ is of the intersection of said line y' and said cord axis, wherein said angle λ is located below said cord axis and towards said cord proximal end from said some of said abutment surfaces.

12. A method of attaching a gaiter to a footwear, wherein the directions of upward, downward, forward, rearward, and horizontal are defined as their usual meaning on the condition that said footwear is in use on a horizontal ground surface, wherein the direction of outboard to inboard is defined as from the side or rear or front of an outsole toward the interior of the tread surface parallel to the tread surface, said method comprising:

(a) forming an outsole, said outsole having two protrusions, thereby forming a slot between said two protrusions, wherein said slot has an outboard terminus, wherein said slot has an inboard terminus, wherein an abutment surface is located on one or both of said two protrusions, wherein said abutment surface is located near to said inboard terminus of said slot, wherein said abutment surface is on a projection from one or both of said two protrusions, wherein said abutment surface approximately faces an outsole abutment surface such that an expanded end of a cord may simultaneously engage both said abutment surface and said outsole abutment surface, wherein a slot terminus surface is located near said slot inboard terminus and is approximately between said outsole abutment surface and said inboard slot terminus, wherein said slot terminus surface is approximately normal to an axis of said slot nearest to said inboard slot terminus, and;

(b) fabricating said footwear with said outsole, and;

(c) forming said cord, wherein said cord has said expanded end, wherein said cord has a gaiter end, wherein said cord is relatively inelastic or elastic, and;

(d) assembling said cord and said footwear such that at least of some cord is within said slot and at least some of said expanded end is between said abutment surface and said outsole abutment surface.

13. The method of attaching a gaiter to said footwear of claim 12, wherein said abutment surface faces upward and inboard.

14. The method of attaching a gaiter to said footwear of claim 12, wherein said outsole abutment surface faces approximately rearward.

15. The method of attaching a gaiter to said footwear of claim 12, wherein said outsole abutment surface faces approximately rearward and downward, wherein said abutment surface faces approximately forward.

16. A method of attaching a gaiter to a footwear, wherein the directions of upward, downward, forward, rearward, and horizontal are defined as their usual meaning on the condition that said footwear is in use on a horizontal ground surface, wherein the direction of outboard to inboard is defined as from the side or rear or front of an outsole toward the interior of the tread surface parallel to the tread surface, said method comprising:

(a) forming an outsole, wherein said outsole includes two protrusions, wherein said two protrusions are adjacent and thereby form a slot between said two protrusions, wherein said slot terminates at both an inboard slot terminus and an outboard slot terminus, wherein said inboard slot terminus is inboard of said outboard terminus, wherein an abutment surface is located on one or both of said two protrusions, wherein said outsole includes a retention means for temporarily retaining an expanded end of a cord onto said outsole against pull from said gaiter in hiking conditions, wherein said retention means includes said abutment surface and an outsole surface which is located approximately opposite said abutment surface, (b) assembling said outsole into said footwear.

17. The method of claim 16, wherein said retention means is located near said inboard slot terminus, wherein said abutment surface is located generally inboard of said inboard slot terminus.

18. The method of claim 16, wherein said retention means further includes an outsole abutment surface which faces at least partially downward, wherein said outsole abutment surface is located on said outsole approximately opposite said abutment surface, wherein said abutment surface partially faces said outsole abutment surface such that said abutment surface and said outsole abutment surface form a knot space immediately inboard to said inboard slot terminus.

19. The method of claim 16, wherein said abutment surface at least partly faces inboard and at least partly faces upward.

20. The method of claim 16, wherein said abutment surface faces at least partly inboard and at least partly faces downward.

* * * * *